US005156409A

United States Patent [19]

Barnes

[11] Patent Number: 5,156,409

[45] Date of Patent: Oct. 20, 1992

[54] GAME

[76] Inventor: Sharron Barnes, 3301 N. 75th St., Lincoln, Nebr. 68507

[21] Appl. No.: 629,569

[22] Filed: Dec. 18, 1990

[51] Int. Cl.[5] ..... A63B 67/00
[52] U.S. Cl. ..... 273/444; 273/57.1
[58] Field of Search ..... 273/57.1, 444, 283, 273/284

[56] References Cited

U.S. PATENT DOCUMENTS

| | | | |
|---|---|---|---|
| 1,155,273 | 9/1915 | Quade | 273/57.1 |
| 3,454,279 | 7/1969 | Foley et al. | 273/444 |
| 3,515,385 | 6/1970 | Gunderson | 273/57.1 |

OTHER PUBLICATIONS

Darwin A. Hindman, Kick the Can and Over 800 Other Active Games and Sports for All Ages, pp. 166–168 Hopscotch Jun. 1984.

*Primary Examiner*—Paul E. Shapiro
*Attorney, Agent, or Firm*—Vincent L. Carney

[57] ABSTRACT

To provide an active learning game, game pieces are provided of sufficient size so that a child may hop from one to the other safely, with the surfaces having sufficient coefficients of friction so that the force of the child jumping onto them does not cause the child to slip nor cause the game pieces to slide and with top surfaces being marked with numbers, shapes, letters or words that are to be recognized by the child. Cards are provided having indicia on them such as numbers, images, letters, words or the like so that the child may draw a card having on it a number, letter, word or image such as that of a particular animal and be required to hop to the location having that number, image, letter or word on it.

8 Claims, 2 Drawing Sheets

GAME

BACKGROUND OF THE INVENTION

This invention relates to educational toys.

It is known to use two way to teach children to recognize animals or numbers or the like and numerous games are available for such purposes. In the prior art games of this type, the matching of words with shapes or the location of numbers or the like is relatively passive, being performed on a vertical or horizontal game board. This type of learning device has a disadvantage in that there is insufficient activity for energetic children to hold their attention.

Games are known in which children hop from place to place such as a well-known game called "Hop Scotch" in which a child hops from square to square until the child reaches a selected square. In the prior art games of this type, the child throws an object on a set of squares each of which is numbered and then hops through the squares and back, picking the object up on the way back. This prior art game has a disadvantage in that the learning function is relatively inactive since the child is not forced to select a particular number or image in abstract and hop to that number or mirage relying only on recognition and knowledge of the number or image. Some prior art games of this type are disclosed in U.S. Pat. Nos. 4,773,864, 4,185,819, 3,768,809, 3,515,385, 3,139,182 and German patents 2,339,207, 2,716,219 and 3,021,711.

SUMMARY OF THE INVENTION

Accordingly, it is an object of the invention to provide a novel game.

It is a further object of the invention to provide an educational toy which is adaptable to learning a variety of different facts.

It is a further object of the invention to provide a game that will teach children recognition of different objects, numbers, letters or words while permitting the children to remain active.

it is a further object of the invention to provide an educational game that aids in teaching coordination and is adaptable to teaching a wide variety of matters such as right or left to young children.

In accordance with the above and further objects of the invention, game pieces are provided of sufficient size so that a child may hop from one to the other safely. For this purpose, the surfaces have sufficient coefficients of friction so that the force of the child jumping onto them does not cause the child to slip nor cause the game pieces to slide. The top surfaces must be relatively smooth to not cause injury and be capable of being permanently marked with numbers, shapes, letters or words that are to be recognized by the child.

Advantageously, cards are provided having indicia on them such as numbers, images, letters, words or the like. The child may draw a card having on it a number, letter, word or image such as that of a particular animal and be required to hop to the location having that number, image, letter or word on it. In the alternative, the game may be played by an instructor or other participant naming the number, image, letter, or word.

In one embodiment, flat game pieces have an opening in their center and other pieces permanently marked with indicia using relatively stable and permanent paint are shaped to be insertable into the game pieces. They have the shape of the opening in the game piece and: (1) are slightly smaller in size so as to fit conformingly into the opening; (2) sufficiently thin so as to not extend above the top surface of the game piece and thus trip the child or be easily dislodge by accident during the game; but (3) not so thin as to create a depression which may trip the child or the like.

In playing the game, the game pieces are put on a floor which may be a wooden floor, tile floor, grass, carpet or the like sufficiently close to each other to permit a child to hop from one to the other. The pieces are marked with some indicia and the children have the indicia revealed to them either by taking a card from a shuffled deck or having it told to them or the like and must hop from game piece to game piece until they reach the indicated indicia. The pieces may be spaced in hop scotch pattern so that the child hops with one foot onto one of the game pieces and then onto two simultaneously and so on and may be used in conjunction with a throwing piece if desired.

As can be understood from the above description, the game of this invention has several advantages, such as: (1) children learn actively while playing a game; (2) a variety of different facts, recognition of images or the like can be taught with the same game pieces; and (3) the game is active enough to maintain the intersect of young children.

SUMMARY OF THE DRAWINGS

The above noted and other features of the invention will be better understood from the following detailed description when considered with reference to the accompanying drawings in which.

DETAILED DESCRIPTION

Figure 1:
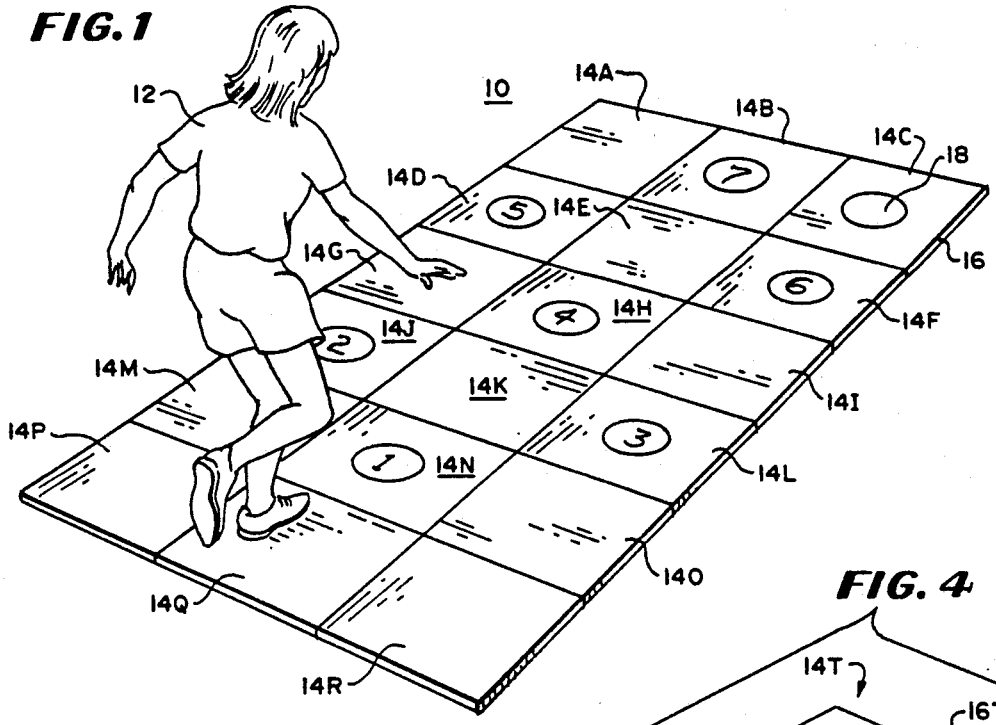
FIG. 1 is a simplified perspective view of a child playing the game.

In FIG. 1, there is shown a game in progress having a child 12 hopping from one game piece to another game piece of the set 10 of game pieces 14A–14R. The game pieces each include base portion 16 and an indicia potion 18, as indicated on game piece 14c with the indicia portion 18 including any meaningful symbol, such as numbers or letters or other characters or designs or drawings of animals or the like. Preferably, the symbol is one useful for a child to learn. For example, the design may be the common traffic symbols for stop signs or the like and may be in black and white, but are preferably colored.

Some base portions 16 may not include an indicia portion: either including an insert with nothing on it as indicated by the game piece 14C, or a base with no opening as indicated by the game piece 14A. Such game pieces may be used to form a continuous surface to avoid tripping the child, or instead the game pieces can be spaced from each other and may all contain inserts with designs.

In playing the game, the child 12 or another person draws a card which has the designation on it or in the alternative, a person may mention a number or a word or a letter corresponding to that which the child is to recognize. The child then hops from game piece to game piece until the child reaches the game piece having the proper symbol and then hops back, thus indicating recognition. The game may be non-competitive since a child can draw the cards themselves or may be competitive in that the competitors select symbols or the like for the player that is to hop from place to place. The hopping may be alternately on one foot and then two, such as in a hop scotch game or on only one foot.

There are obvious variations of the game, such as for example, an object may be thrown onto a game piece and then the symbol identified orally, after which the same or another player hops to the game piece to pick up the object. However, in all of the versions, the game pieces should be spaced from each other a distance sufficiently close to permit the child to hop from one to the other and must be less than three feet from each other. The surfaces of the game pieces must be such as to avoid sliding of the pieces upon the floor or tripping or slipping by the participants on the surface of the pieces. Thus, there must be: (1) a high coefficient of friction above 0.15 between one side and surfaces such as wood, tile, carpeting, concrete or the like; (2) similar high coefficient of friction between shoe soles or socks and the other side; and (3) low elevation and smoothness of the side onto which the participant hops.

Figure 2:
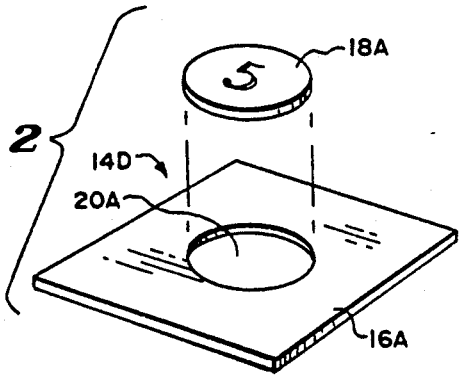
FIG. 2 is an exploded perspective view of one embodiment of a game piece.

In FIG. 2, there is shown an exploded perspective view of one version of game piece 14D having an indicia insert 18A with an indicia 5 upon it as an example and a base portion 16A having an opening 20 A to receive the indicia insert or indicia portion 18A. The opening 20A conforms to the size of the periphery of the indicia insert 18A and the thickness of the indicia insert 18A and the opening 20A are such as to permit the indicia insert to be slightly below the surface but not more than 1/16 inch below the surface of the base portion 16A. The opening 20A may be entirely through the base portion 16A or partly through it.

The base members 16 should be at least 60 square inches in surface are a so that a child may easily land upon it when jumping or hopping and should have square sides of 9 inches by 9 inches or a diameter of 9 inches. In the preferred embodiment, they are square blocks 12 inches by 12 inches with a cylindrical center indicia member having a diameter of 5 inches. The size of the base must in every instance be large enough to accommodate the indicia inserts 18.

The thickness of the base portion of 16A should be between 1/32 inch and ½ inch and in the preferred embodiment is ⅛ inch. It is made of a sturdy material with a durometer of less than 30 and in the preferred embodiment has a durometer of 7. The base portion 16A in the preferred embodiment is formed of rubber based neoprene for an adequate coefficient of friction but may be made of other materials having high coefficients of friction or materials which when roughened have such coefficients of friction. The indicia members are PBC foam printed with durable paint to withstand wear.

Figure 3:
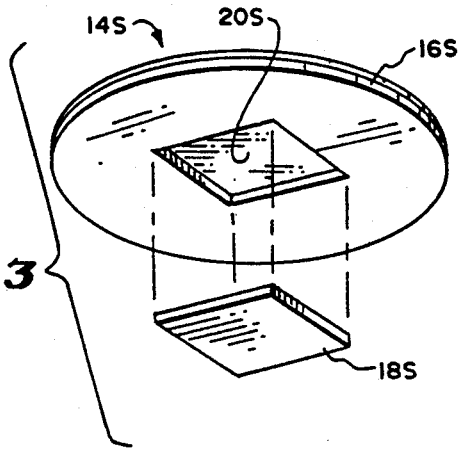
FIG. 3 is an exploded perspective view of another embodiment of the game piece.

In FIG. 3, there is shown a perspective view of another type of game piece 14S having base portion 16S with a square opening 20S intended to conform to an indicia piece 18S. The dimensions may be the same and they may operate in the same manner as that of the embodiment of FIG. 2 or the indicia may be different, such as letters or designs or the like and the base portion may have a translucent portion with a cover with the indicia piece 18S fitting through the bottom to provide a translucent cover over the printing or painting of the indicia for greater durability. However, the coefficient of frictions should be maintained to void accidents.

Figure 4:
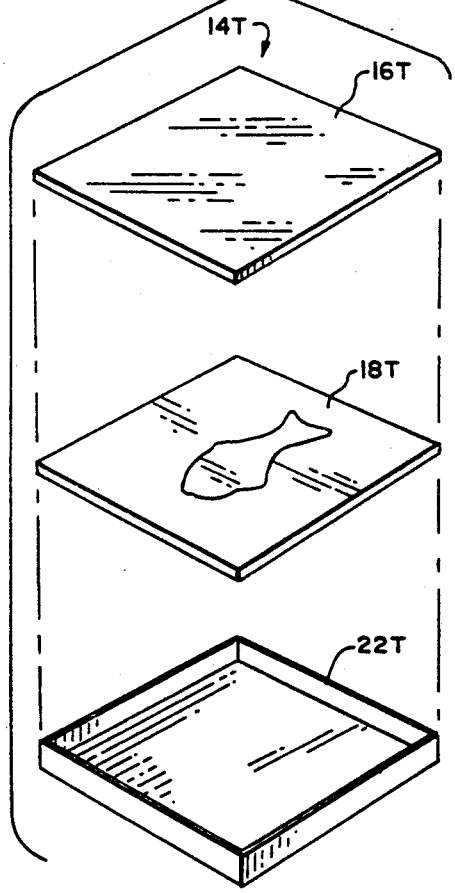
FIG. 4 is an exploded perspective view of still another embodiment of the game piece.

In FIG. 4, there is shown an exploded perspective view of still another embodiment of game piece 14T having a bottom member 22T formed as a container with side walls and a bottom wall and adapted to receive a conforming flat member 18T bearing an indicia, such as a design of a fish as shown and a top member 16T, at least a portion of which is translucent with both the flat member 18T and the top potion 16T fitting into and between the side walls of the bottom member 22T. Of course, the top member 16T can have downwardly extending side walls but must have a portion through which the indicia of the flat member 18T can be seen.

Figure 5:
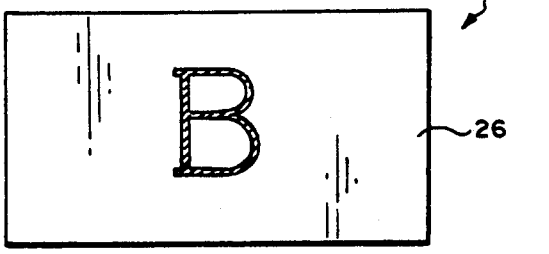
FIG. 5 is a plan view of one side of a game card.
Figure 6:
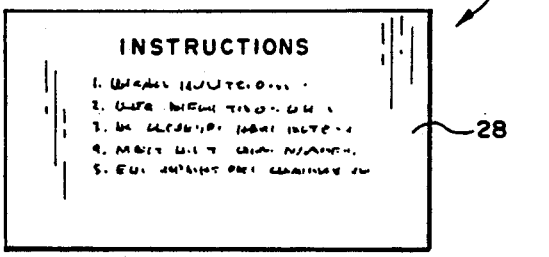
FIG. 6 is a plan view of another side of the same game card of FIG. 5.

In FIGS. 5 and 6, there are shown one side 26 of a playing card 24 which contains the indicia to be used in playing the game as described above and another side 28 of a playing card 24 which may include the name of the game, trademarks or instructions for playing typical games and the like.

Figure 7:
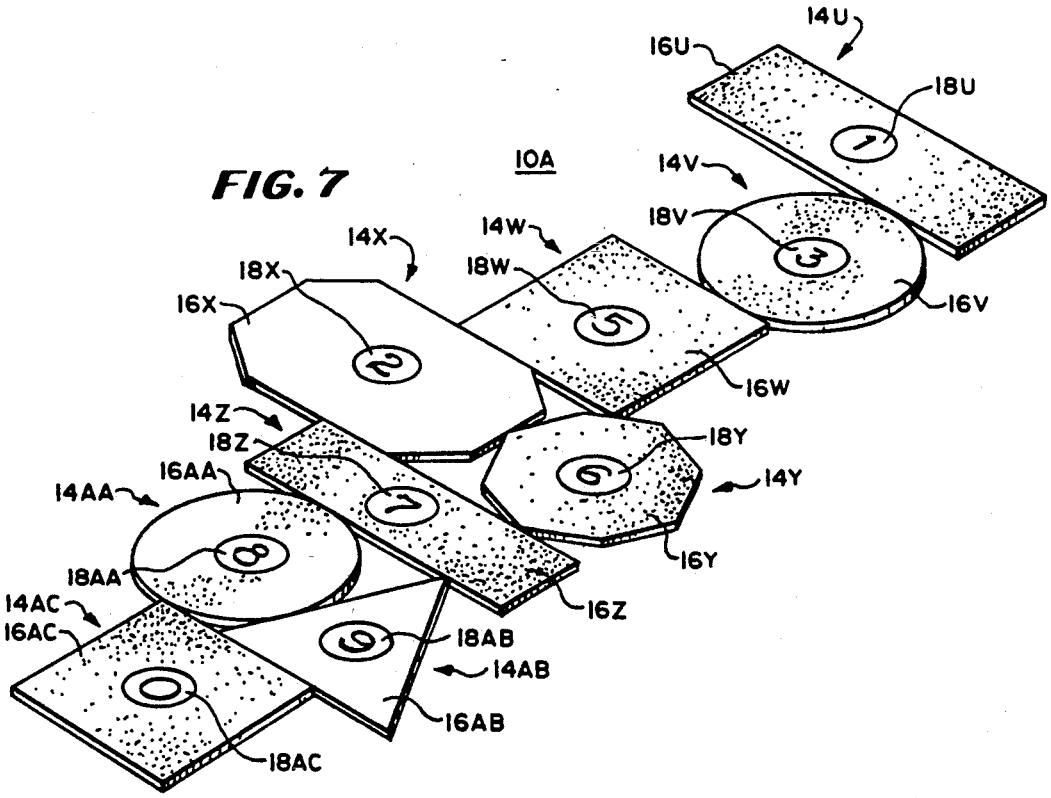
FIG. 7 is a perspective view of another arrangement of game pieces similar to that of FIG. 1.

In FIG. 7, there is shown a perspective view of still another embodiment of game 10A having different shaped game pieces 14U–14AC having corresponding base members 16U–16AC and indicia members 18U–18AC. This game is substantially the same as the embodiment 10 of FIG. 1 but has different shaped game pieces and the same pieces are spaced from each other to serve as another variable for children to learn shapes by calling out the different shapes or being required to go to a specific shape and identify the indicia on it.

To make the game pieces, a suitable plastic is die cut to provide an opening and suitable indicia members, such as foam plastic are die cut, both being cut from sheets for economy. The indicia may be silk screened onto the members to fit them together and cards printed to conform.

In use, the game pieces are arranged on a flat surface, being spaced from each other in accordance with the ability of the players to hop from one game piece to the another. Thus, for smaller children, they will be closer together and may even be touching and for larger children, they may be spaced further apart.

The indicia members can be selected to familiarize a young child with numbers or with letters or designs, such as certain animals that the young children are to learn. For older children, words may be selected.

To introduce competition, a card may be drawn either by the participant or by another child indicting the character to be recognized and the player must then hop to and stop at that character and hop back, thus indicating recognition. In the alternative, a word or design may be spoken by one contestant to another so that the child must hop to the particular location with the indicia upon it.

From the above description, it can be understood that the game and game pieces of this invention have several advantages, such as: (1) the game pieces have great variety and can teach a number of different characters to different age groups; (2) the children learn coordination, learn their right leg from their left leg and learn to follow instructions; (3) the children ar able to move about and thus, their attention is held more easily; and (4) the game pieces are adaptable to a number of competitive games or to games that may be played alone by a single child, all of which may be selected for maximum teaching effect.

Although a preferred embodiment of the invention has been described in some detail, many variations and modifications of the preferred embodiment may be made without deviating from the invention. Therefore, it is to be understood that, within the scope of the appended claims, the invention may be practiced other than as specifically described.

What is claimed is:

1. A method of playing a game comprising the steps of:

placing game pieces with indicia upon them at locations on a floor less than five feet from each other, wherein the game pieces have a thickness of less than a ½ inch;

selecting an indicia from a deck of cards having indicia corresponding to those on the game pieces; and hopping from one piece to the other until the indicia is reached and then hopping back.

2. A method of playing a game comprising the steps of:

placing game pieces with indicia upon them at locations on a floor less than five feet from each other, wherein the game pieces have a thickness of less than a ½ inch;

selecting an indicia;

calling the selected indicia out to a participant by another participant wherein the selected indicia is a number; and hopping from one piece to the other until the indicia is reached and then hopping back.

3. A method of playing a game comprising the steps of:

placing game pieces with indicia upon them at locations on a floor less than five feet from each other, wherein the game pieces have a thickness of less than a ½ inch;

selecting an indicia;

hopping from one piece to the other until the indicia is reached and then hopping back; and calling out the indicia upon which the participant hops wherein the participant is disqualified if the participant fails to call out the correct indicia.

4. A method of making a game piece comprising the steps of:

obtaining sheet material;

cutting the sheet material into flat sections;

cutting an opening in the center of the flat sections;

forming members, which members have a size conforming to the opening cut in the flat sections; and placing indicia on the members.

5. A method according to claim 4 further including the step of printing cards having indicia corresponding to those on the members.

6. A method according to claim 4 in which the step of obtaining sheet material includes the step of obtaining high coefficient of friction sheet plastic having a thickness of between 1/32 inch and ½ inch.

7. A game comprising:

game pieces;

said game pieces having a base portion and an indicia portion;

said game pieces having flat upper and bottom surfaces, each of which resist skidding and sliding;

the indicia portion being adapted to be mounted to the base portion;

the surfaces of the game pieces having a surface area of at least 60 square inches;

the thickness of the game pieces being no greater than a ½0 inch; and a deck of cards having indicia upon them which correspond to the indicia on the game pieces.

8. A game in accordance with claim 7 in which the base portion contains an aperture and the indicia portion is shaped to conform to the aperture.

* * * * *